US005758415A

United States Patent [19]

Hara

[11] Patent Number: 5,758,415

[45] Date of Patent: Jun. 2, 1998

[54] METHOD OF MANUFACTURING A TAPPET IN AN INTERNAL COMBUSTION ENGINE

[75] Inventor: Nobuo Hara, Fujisawa, Japan

[73] Assignee: Fuji Oozx Inc., Japan

[21] Appl. No.: 735,983

[22] Filed: Oct. 25, 1996

[51] Int. Cl.[6] ..... F01L 1/14

[52] U.S. Cl. ..... 29/888.43; 29/505; 123/90.51; 74/569

[58] Field of Search ..... 123/90.48, 90.51; 74/569; 29/888.03, 888.43, 505

[56] References Cited

U.S. PATENT DOCUMENTS

| | | | |
|---|---|---|---|
| 1,341,134 | 5/1920 | Keller . | |
| 1,380,586 | 6/1921 | Pelletier . | |
| 1,381,223 | 6/1921 | Pelletier . | |
| 1,406,986 | 2/1922 | Keller . | |
| 1,649,409 | 11/1927 | Jardine . | |
| 1,850,544 | 3/1932 | Gray . | |
| 2,157,867 | 5/1939 | Robertson et al. . | |
| 2,954,016 | 9/1960 | Leese . | |
| 3,162,185 | 12/1964 | Knoblock . | |
| 3,421,734 | 1/1969 | Updike et al. . | |
| 5,062,397 | 11/1991 | Larson . | |
| 5,077,140 | 12/1991 | Luthra et al. . | |
| 5,084,113 | 1/1992 | Mori et al. . | |
| 5,168,841 | 12/1992 | Suzuki et al. . | |
| 5,226,977 | 7/1993 | Kitaguchi et al. . | |
| 5,251,587 | 10/1993 | Mori | 123/90.51 |
| 5,284,112 | 2/1994 | Takehara et al. | 123/90.51 |
| 5,400,749 | 3/1995 | Koizumi et al. | 123/90.51 |
| 5,431,136 | 7/1995 | Kenmoku et al. . | |
| 5,537,744 | 7/1996 | Hirose . | |
| 5,609,128 | 3/1997 | Hirose . | |

(List continued on next page.)

FOREIGN PATENT DOCUMENTS

| | | | |
|---|---|---|---|
| 0 556 954 A1 | 8/1993 | European Pat. Off. . | |
| 592 908 A1 | 4/1994 | European Pat. Off. . | |
| 592908 | 4/1994 | European Pat. Off. | 123/90.48 |
| 788 537 | 10/1935 | France . | |
| 1121876 | 8/1956 | France . | |
| 2083890 | 12/1971 | France . | |
| 2488328 | 12/1982 | France . | |
| 2 584 138 | 1/1987 | France . | |
| 898 701 | 12/1953 | Germany . | |
| 21 47 195 | 4/1972 | Germany . | |
| 24 11 430 | 9/1975 | Germany . | |
| 27 39 403 | 3/1979 | Germany . | |
| 30 17 990 A1 | 11/1981 | Germany . | |
| 31 49 815 A1 | 7/1983 | Germany . | |
| 34 33 606 A1 | 3/1986 | Germany . | |
| 586064 | 12/1958 | Italy . | |
| 55-145155 | 11/1980 | Japan . | |
| 56-13164 | 3/1981 | Japan . | |
| 5-171908 | 7/1983 | Japan . | |
| 60-43107 | 3/1985 | Japan . | |
| 60-47809 | 3/1985 | Japan . | |
| 61-81505 | 4/1986 | Japan . | |
| 61-234210 | 10/1986 | Japan . | |

(List continued on next page.)

OTHER PUBLICATIONS

Publication No. JP2040008 Inventor: Hirai Yoshiki Publication Date: Feb. 8, 1990 Title: Manufacture of Valve Lifter.

Publication No. JP4246210 Inventor: Ishida Yasuaki, et al. Publication Date: Sep. 2, 1992 Title: Manufacture Method for Engine Valve Lifter.

Publication No. JP60067707 Nakayama Nobuyoshi, et al. 1 pg Publication Date: Apr. 18, 1985 Title: Exhaust/Intake Valve Rotor in Internal–Combustion Engine.

*Primary Examiner*—Weilun Lo
*Attorney, Agent, or Firm*—Graham & James LLP

[57] ABSTRACT

A tappet in an internal combustion engine comprises a cylindrical body and a cam receiving plate on the top wall of the cylindrical body. To manufacture the tappet by forging, light metal material is provided on the surface which has a groove of the cam receiving plate, and forged in a die to mold the body and to connect the body with the cam receiving plate by a single step, thereby decreasing the number of mechanical steps and cost.

4 Claims, 3 Drawing Sheets

U.S. PATENT DOCUMENTS

| | | | |
|---|---|---|---|
| 3,649,380 | 3/1972 | Tauschek . | |
| 3,683,876 | 8/1972 | Lesher . | |
| 3,952,713 | 4/1976 | Tauschek . | |
| 3,989,016 | 11/1976 | Morgan . | |
| 4,003,353 | 1/1977 | Tauschek . | |
| 4,075,987 | 2/1978 | Tauschek . | |
| 4,094,280 | 6/1978 | Updike . | |
| 4,141,325 | 2/1979 | Shalaty . | |
| 4,154,424 | 5/1979 | Cherrie . | |
| 4,227,493 | 10/1980 | Updike . | |
| 4,230,491 | 10/1980 | Behnke . | |
| 4,424,773 | 1/1984 | Wendel et al. . | |
| 4,538,558 | 9/1985 | Updike et al. . | |
| 4,768,476 | 9/1988 | Behnke et al. . | |
| 4,768,479 | 9/1988 | Kammeraad . | |
| 4,829,950 | 5/1989 | Kanamura et al. | 123/90.51 |
| 4,852,531 | 8/1989 | Abkowitz et al. . | |
| 4,873,150 | 10/1989 | Doi et al. . | |
| 4,915,069 | 4/1990 | LaFever et al. . | |
| 5,001,019 | 3/1991 | Ito et al. . | |
| 5,013,878 | 5/1991 | Ishikawa et al. . | |
| 5,036,816 | 8/1991 | Mann . | |
| 5,060,607 | 10/1991 | Taniguchi . | |

FOREIGN PATENT DOCUMENTS

| | | |
|---|---|---|
| 62-142815 | 6/1987 | Japan . |
| 62-142816 | 6/1987 | Japan . |
| 62-197609 | 9/1987 | Japan . |
| 62-227072 | 10/1987 | Japan . |
| 64-22497 | 1/1989 | Japan . |
| 64-69705 | 3/1989 | Japan . |
| 1-237310 | 9/1989 | Japan . |
| 1-43019 | 9/1989 | Japan . |
| 2-92494 | 4/1990 | Japan . |
| 2-110211 | 9/1990 | Japan . |
| 2-277762 | 11/1990 | Japan . |
| 5-195729 | 8/1993 | Japan . |
| 5-331617 | 12/1993 | Japan . |
| 6-25824 | 2/1994 | Japan . |
| 6-81614 | 3/1994 | Japan . |
| 6-146824 | 5/1994 | Japan . |
| 6-146825 | 5/1994 | Japan . |
| 196 653 | of 0000 | United Kingdom . |
| 146 770 | 7/1920 | United Kingdom . |
| 2 278 068 | 11/1994 | United Kingdom . |
| 2 282 766 | 4/1995 | United Kingdom . |

METHOD OF MANUFACTURING A TAPPET IN AN INTERNAL COMBUSTION ENGINE

BACKGROUND OF THE INVENTION

The present invention relates to a method of manufacturing a tappet in an internal combustion engine, the tappet having a body which is made of light metal such as Al alloy, and in particular to a method of manufacturing a tappet in an internal combustion engine, the tappet having a cam receiving plate made of wear resistant material at the contact surface with a rotary cam.

To lighten a direct acting type valve operating mechanism, tappets made of Al alloy have been widely used instead of conventional steel tappets. Al alloy tappets have lower strength and wear resistance than steel tappets. Therefore, on the upper surface of a tappet which contacts a rotary cam, a cam receiving plate made of wear resistant material is attached.

To attach the cam receiving plate on the upper surface of the tappet, there are methods of caulking, brazing and pressing engagement of a projection into a groove.

However, in the conventional methods, two members are separately molded and connected,.which increases the number of mechanical steps and cost. For example, in pressing engagement, an Al alloy body and a steel cam receiving plate are separately formed and connected with each other, but it is necessary to improve accuracy in size of the groove and projection which are engaged with each other, which requires a number of mechanical steps and high cost.

SUMMARY OF THE INVENTION

The object of the present invention is to provide a method of manufacturing a tappet in an internal combustion engine, a body of the tappet being molded and integrally connected with a cam receiving plate, thereby decreasing the number of steps for mechanical processing and cost.

To achieve the object, according to the present invention, there is provided a method of manufacturing a tappet in an internal combustion engine, a body of the tappet being made of light metal, a wear resistant hard cam receiving plate being provided on an upper surface of a top wall of the body, the method comprising the steps of:

providing light metal material on a surface which has a groove of the cam receiving plate; and forging the light metal material on the cam receiving plate in a die to mold the body and to connect the body with the cam receiving plate at the same time.

The forging step may be preferably cold forging.

In forging, the cam receiving plate is not plastically deformed, but only soft light metal is plastically deformed to enter the groove of the cam receiving plate, whereby molding of the body and fixing of the cam receiving plate with the body are made by a single step. Therefore, the steps for mechanical processing and cost can be decreased.

BRIEF DESCRIPTION OF THE DRAWINGS

The features and advantages of the invention will become more apparent from the following description about embodiments with respect to appended drawings wherein.

DETAILED DESCRIPTION OF PREFERRED EMBODIMENTS

Figure 1:
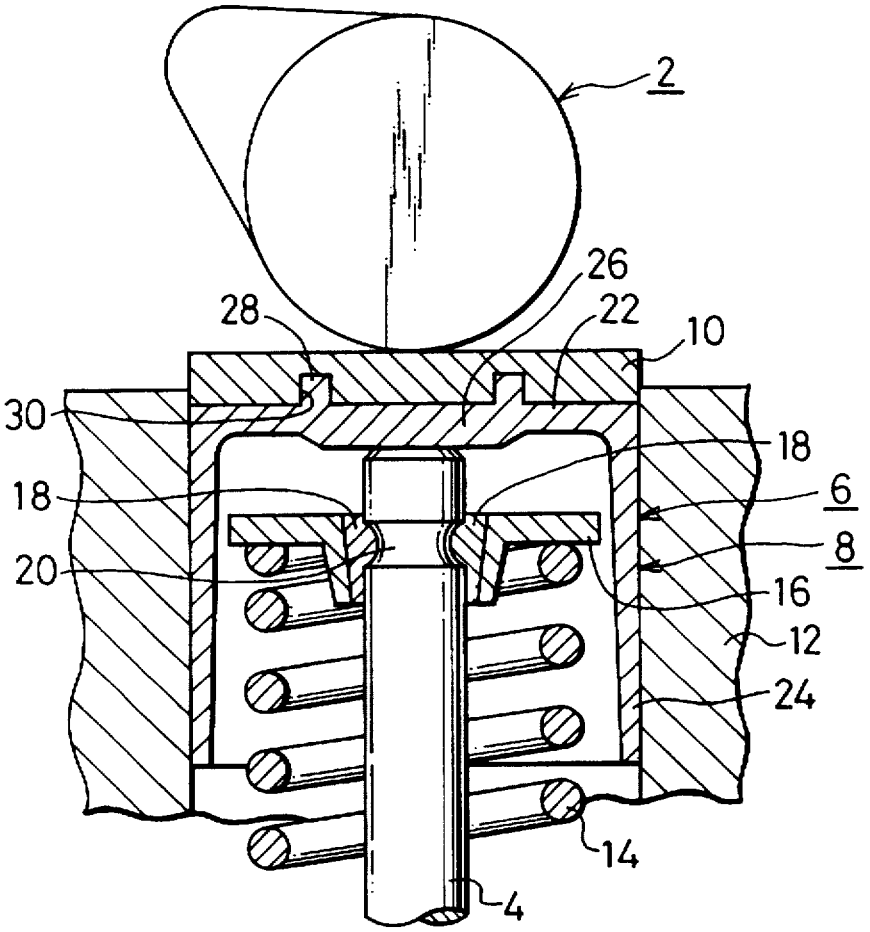
FIG. 1 is a vertical sectioned front view of a direct acting type valve operating mechanism in an internal combustion engine which contains a tappet made by a method according to the present invention.

FIG. 1 illustrates a direct acting type valve operating mechanism which contains a tappet according to the present invention. 2 denotes a cam which rotates together with rotation of a crankshaft(not shown). 4 denotes a valve stem of an intake/exhaust valve. 6 denotes a tappet which follows the cam 2 and reciprocates up and down in FIG. 1 to transmit the movement to valve stem 4 of the intake/exhaust valve 4. 12 denotes a cylinder head which guides reciprocating movement of the tappet 6. 14 denotes a valve spring for allowing the intake/exhaust valve to close. 16 denotes a valve spring retainer for transmitting force of the valve spring 14 to the intake/exhaust valve. 18 denotes a pair of cotters which are engaged in an annular groove 20 of the valve stem 4 of the intake/exhaust valve so that the valve spring retainer 16 may be attached around the valve stem 4.

The tappet 6 comprises a body 8 and a cam receiving plate 10. The body 8 is molded from Al alloy and comprises a top wall 22 and a cylindrical portion 24. The top wall 22 which is put between the cam 2 and the valve stem 4 is subjected to high compression load, so that a thicker portion 26 in the middle of the lower surface is formed. On the upper surface of the top wall 22, there is formed an annular projection 28 the center of which coincides with the axis of the tappet. The cam receiving plate 10 which needs wear resistance to sliding with rotation of the cam 2 is made of steel and, if necessary, subjected to heat treatment.

On the lower surface of the cam receiving plate 10, there is an annular groove 30 at a position corresponding to the annular projection 28 of the body 8. The annular projection 28 of the body 8 is engaged in the annular groove 30, so that the body 8 is connected with cam receiving plate 10.

The present invention relates to a method of manufacturing the tappet 6 as mentioned above. The first embodiment of the method according to the present invention will be described with respect to FIG. 2. In manufacturing, the tappet is inverted.

Figure 2A:
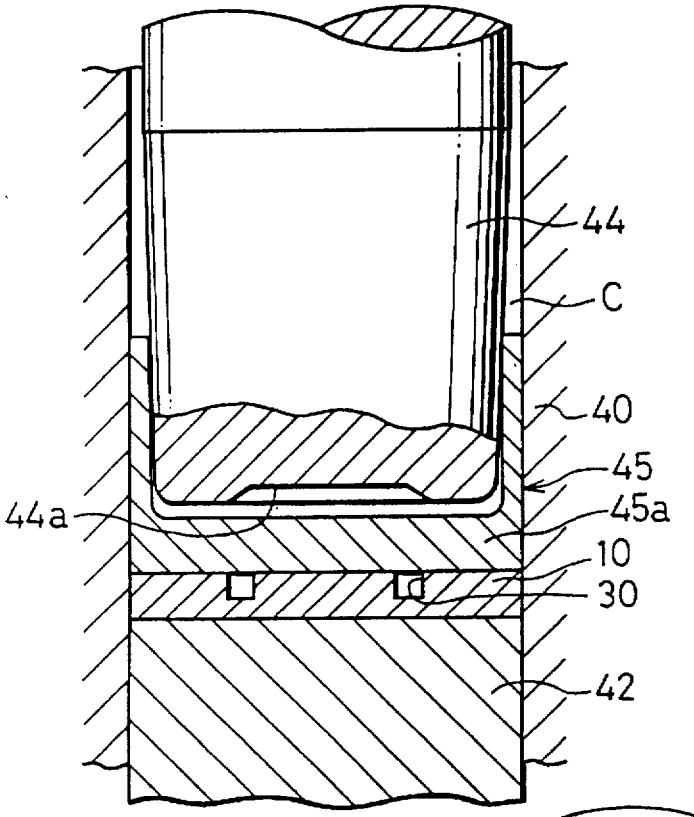
FIGS. 2*a* and 2*b* are sectional views of steps of the first embodiment, (a) being before forging, (b) being after forging.
Figure 2B:
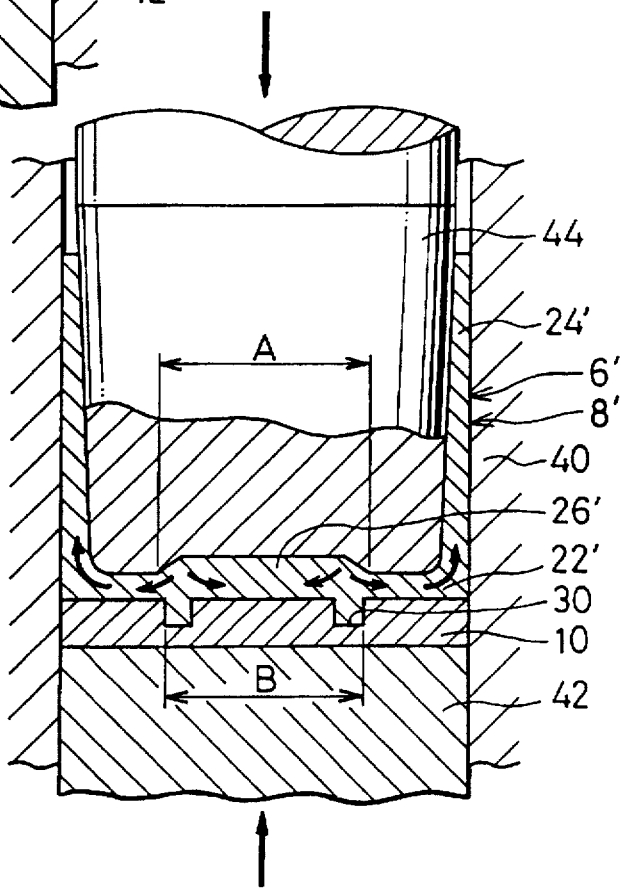

In FIG. 2, 40 denotes a stationary die for molding. 42 and 44 denote moving lower and upper punches. The upper surface of the lower punch 42 is flat, and the lower surface of the upper punch 44 has a recess 44*a* which the thicker portion 26 of the top wall 22 of the body 8 fits. Between the die 40 and the upper punch 44, there is a gap for forming the cylindrical portion 24 of the body 8.

As shown in FIG. 2(*a*), the steel cam receiving plate 10 in which the annular groove 30 was already formed is placed on the lower punch 42 in the die 40 to direct the surface which has the annular groove 30 upwards. On the cam receiving plate 10, there is an inverted intermediate material 45 made of Al alloy for forming the body 8, the intermediate material 45 being shorter than body 8 to be molded and having a thicker top wall 45*a*.

As shown in FIG. 2(*b*), the upper and lower punches 42 and 44 move simultaneously, or either of them moves to forge the intermediate material 45. The hard steel cam receiving plate 10 is not plastically deformed, but only Al alloy intermediate material 45 is plastically deformed to decrease thickness of the top wall 45*a* and to flow into the gap "C", so that the body 8' and the cam receiving plate 10 are integrally combined. The contents of the top wall 45*a* flow at smaller amount into the gap "C", so that they flow towards and away from the center of the thicker portion 26' owing to the bottom section of the upper punch 44 as shown in the arrows in FIG. 2(*b*).

The annular groove 30 of the cam receiving plate 10 may be preferably formed at a neutral position of material flow that the outer diameter "B" of the annular groove 30 is equal to or slightly smaller than the maximum outer diameter "A" of a thicker portion 26'. Accordingly, in forging, the material of the top wall 22' is closely filled in the annular groove 30, so that larger bonding strength is obtained between the body 8' and the cam receiving plate 10.

Figure 3A:
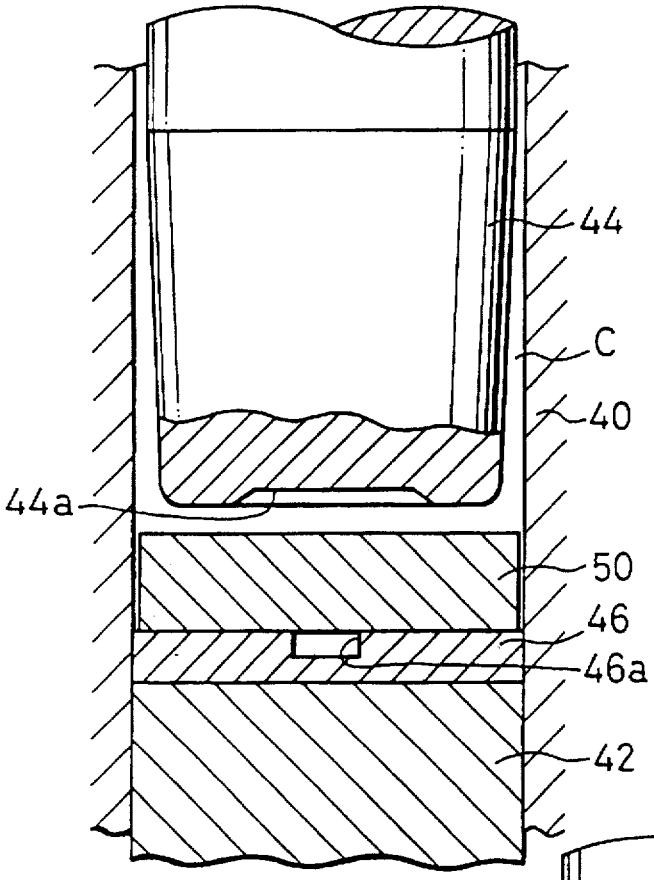
FIGS. 3*a* and 3*b* are sectional views of steps of the second embodiment, (a) being before forging, (b) being after forging.
Figure 3B:
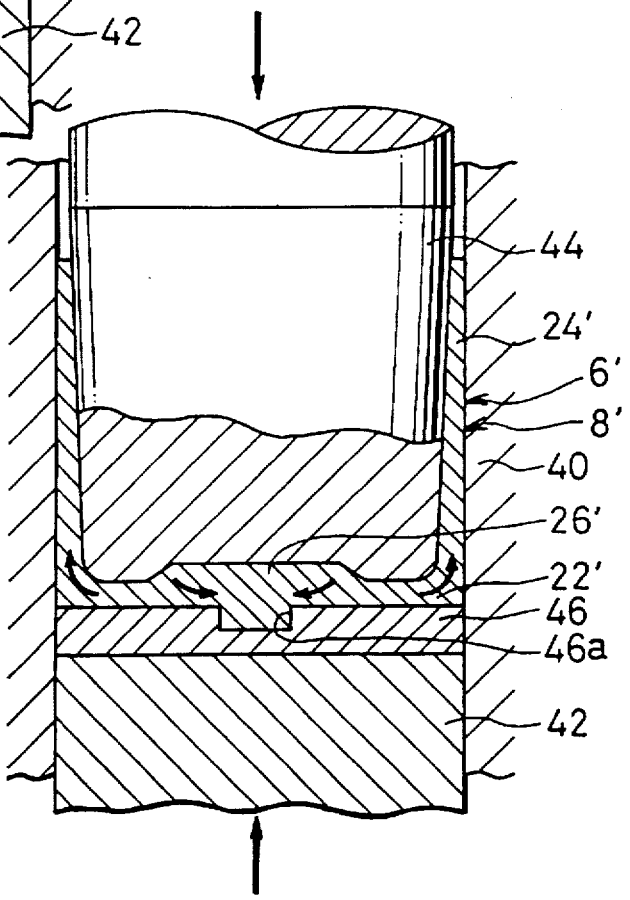

FIG. 3 illustrates the second embodiment of the present invention, in which a body is molded and connected with a cam receiving plate by a single step without forming the intermediate material 45.

First, as shown in FIG. 3(*a*), a cam receiving plate 46 in which a groove 46*a* was already formed is placed on the lower punch 42 while the surface which has the groove 46*a* is directed upwards. A cylindrical material 50 is put on the lower punch 42.

Then, as shown in FIG. 3(*b*), the material 50 is forged by upper and lower punches 42 and 44. As well as the first embodiment as above, only the material 50 is plastically deformed and flows into a groove 46*a* of the cam receiving plate 46, a recess 44*a* and a gap "C". Therefore, the body 8' is integrally connected with the cam receiving plate 46.

As mentioned in the second embodiment, when the body 8' is molded from the cylindrical material 50 by a single step, there is a neutral point between flow to the gap "C" for forming a cylindrical portion 24' and flow towards the center. Thus, when a groove 46*a* is formed in the middle of the cam receiving plate 46, the contents of a top wall 22' vigorously flow into the groove 46*a* and are filled therein, so that bonding strength between the body 8' and the cam receiving plate 46 becomes larger.

According to the method as mentioned above, it could avoid necessity that the body 8 and the cam receiving plate 10 are separately molded and connected to each other by any fixing means in the prior art, thereby decreasing the number of manufacturing steps and its cost. The tappet 6' molded by forging is subjected to heat treatment, and the cylindrical portion 24' is processed at the outer circumferential surface and end faces to manufacture a finished tappet 6.

In the foregoing embodiments, the body 8 and the cam receiving plate 10 are made of Al alloy and steel, but are not limited thereto. For example, the body 8 may be made of light metal alloy such as Mg alloy, and the cam receiving plate 10 may be made of cast iron other than steel, or other material which provides sufficient strength and wear resistance. The groove 30 may be concave and a plurality of grooves may be formed at a predetermined space.

The foregoings relate to embodiments of the present invention. Various changes and modifications may be made by person skilled in the art without departing from the scope of claims wherein:

What is claimed is:

1. A method of manufacturing a tappet in an internal combustion engine, a body of the tappet being made of light metal, a wear resistant hard cam receiving plate being provided on an upper surface of a top wall of the body, the method comprising the steps of:

providing light metal material on a surface of the cam receiving plate; and forging the light metal material on the cam receiving plate in a die to mold the body and to connect the body with the cam receiving plate at the same time wherein there is a thicker portion in the middle of the top wall of the body, a groove being formed in the cam receiving plate at a neutral position of flows of contents of the light metal material towards and away from a center of the thicker portion during forging.

2. The method as defined in claim 1 wherein the light metal material comprises a cylindrical intermediate material which is shorter than the body to be molded, the groove comprising an annular groove formed at a position corresponding to an outer circumference of the thicker portion of the top wall.

3. The method as defined in claim 1 wherein the light metal material is cylindrical, and wherein the groove is a circular groove being formed in the middle of the cam receiving plate.

4. The method as defined in claim 1 wherein the forging step comprises cold forging.

* * * * *